US008681051B2

(12) United States Patent
Huang et al.

(10) Patent No.: US 8,681,051 B2
(45) Date of Patent: Mar. 25, 2014

(54) MULTIBAND PRINTED ANTENNA

(75) Inventors: Yi-feng Huang, New Taipei (TW); Jia-hung Su, New Taipei (TW); Kai Shih, New Taipei (TW); Ching-feng Tseng, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 250 days.

(21) Appl. No.: 13/229,638

(22) Filed: Sep. 9, 2011

(65) Prior Publication Data

US 2013/0063311 A1 Mar. 14, 2013

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 846
See application file for complete search history.

(56) References Cited

U.S. PATENT DOCUMENTS

| | | | | |
|---|---|---|---|---|
| 6,897,823 | B2 * | 5/2005 | Iida et al. | 343/770 |
| 8,305,273 | B2 * | 11/2012 | Cheng et al. | 343/700 MS |
| 2005/0110692 | A1 * | 5/2005 | Andersson | 343/702 |
| 2008/0180330 | A1 * | 7/2008 | Wei-Shan et al. | 343/700 MS |
| 2008/0180333 | A1 * | 7/2008 | Martiskainen et al. | 343/722 |
| 2009/0231203 | A1 * | 9/2009 | Ficker et al. | 343/700 MS |

* cited by examiner

*Primary Examiner* — Hoanganh Le
(74) *Attorney, Agent, or Firm* — Cheng-Ju Chiang

(57) ABSTRACT

Provided is a multiband printed antenna for receiving and emitting multiple electromagnetic wave signals of different bands. The multiband printed antenna includes a substrate and a conductive layer formed on a positive surface of the substrate. The conductive layer includes a grounding portion, a plurality of radiating portions controlling different bands and a single feeder point used to transmit electromagnetic wave signals. The multiband printed antenna of the present invention can separately control multiple radiating portions, which have different bands and are together formed on one same substrate, to emit the electromagnetic wave signals at one same feeder point, thereby realizing the object of the single printed antenna controlling multiple bands and greatly reducing the manufacture cost to satisfy the demand of 4G communication industry.

5 Claims, 1 Drawing Sheet

MULTIBAND PRINTED ANTENNA

BACKGROUND OF THE INVENTION

1. Field of the Invention

The present invention relates to a communication device field, and more particularly to a multiband printed antenna adapted for 4G communication device.

2. Description of the Prior Art

With the rapid development of high-tech communication industry, a mobile communication is used more and more widely. Particularly, the 4G communication becomes more and more popular. Therefore, for an antenna of a communication device, such as mobile phone, notebook and so on, the requirement of using the bands is more and more high.

However, at present, for the application and the popularization of a built-in antenna, the built-in antenna has not a high currency in the market due to the limitations of the number of the band and the cost of manufacture. But the built-in antenna is a necessary trend, so the antenna having a low design cost and being built-in the communication device has been become a development trend of the antenna industry.

Hence, it urgently needs a multiband printed antenna, which is adapted for 4G communication and has a low cost, to solve the above question.

BRIEF SUMMARY OF THE INVENTION

An object of the present invention is to provide a multiband printed antenna, being adapted for 4G communication and having a low cost.

To achieve the above object, in accordance with the present invention, a multiband printed antenna is provided for receiving and emitting multiple electromagnetic wave signals of different bands. The multiband printed antenna comprises: a substrate and a conductive layer formed on a positive surface of the substrate. The conductive layer comprises a grounding portion, a plurality of radiating portions controlling different bands and a single feeder point used to transmit electromagnetic wave signals.

Based on the above description, the multiband printed antenna of the present invention can separately control multiple radiating portions, which have different bands and are together formed on one same substrate, to emit the electromagnetic wave signals at one same feeder point, thereby realizing the object of the single printed antenna controlling multiple bands and greatly reducing the manufacture cost to satisfy the demand of 4G communication industry.

DETAILED DESCRIPTION OF THE PREFERRED EMBODIMENTS

For detail describing the technology, the feature, the object and the effect of the present invention, the following embodiment with reference to the accompanying drawings will be given.

Figure 1:
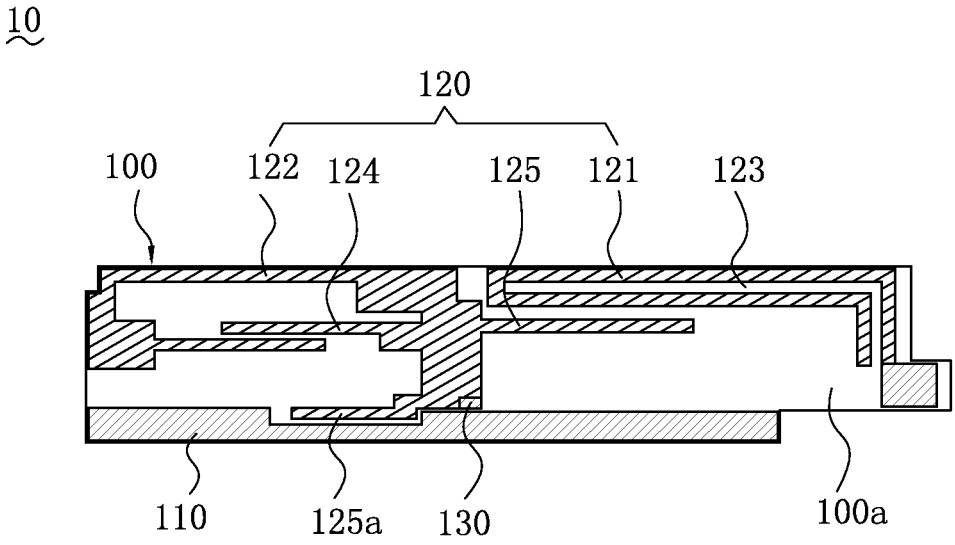
FIG. 1 is a schematic view of a positive surface of a multiband printed antenna of the present invention.
Figure 2:
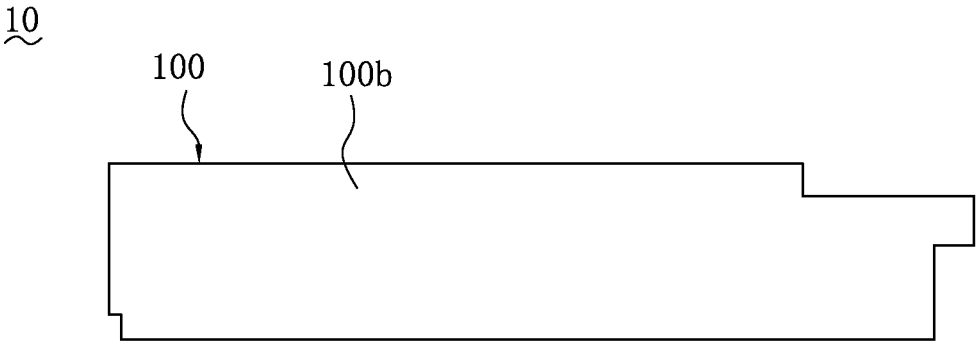
FIG. 2 is a schematic view of a non-positive surface of a multiband printed antenna of the present invention.

Referring to FIGS. 1 and 2, a multiband printed antenna 10 of the present invention is used to receive and emit multiple electromagnetic wave signals of different bands. The multiband printed antenna 10 comprises a substrate 100 and a conductive layer (namely oblique lined area shown in FIG. 1) covered on the substrate 100. The substrate 100 includes a positive surface 100*a* and a non-positive surface 100*b*. The conductive layer is formed on the positive surface 100*a* of the substrate 100. Specifically, the conductive layer includes a grounding portion 110, a plurality of radiating portions 120 controlling different bands, and a single feeder point 130 used to transmit electromagnetic wave signals. Preferably, all of the radiating portions 120 are a copper-coated layer, but both of the grounding portion 110 and the feeder point 130 are a gold-coated layer, so that separately improving the conductive performance thereof.

In this preferred embodiment, the radiating portions 120 includes a first radiating portion 121, a second radiating portion 122, a fourth radiating portion 124 and a fifth radiating portion 125, which are used to control the different bands, respectively. The first radiating portion 121 and the fifth radiating portion 125 are located on the right of the substrate 100. The first radiating portion 121 is located above the fifth radiating portion 125. The first radiating portion 121 is bendingly extended to form an L-shaped gap 123. The L-shaped gap 123 can be used to control another band. The second radiating portion 122 and the fourth radiating portion 124 are located on the left of the substrate 100. The second radiating portion 122 is also bendingly arranged to surround a part of the fourth radiating portion 124. The grounding portion 110 is arranged along the lowest of the substrate 100. There forms an auxiliary portion 125*a*, which has a function of parallel capacitor and can provide an auxiliary function for the fifth radiating portion 125, above the grounding portion 110. Based on above structures, the first radiating portion 121, the second radiating portion 122, the L-shaped gap 123, the fourth radiating portion 124 and the fifth radiating portion 125 are used to control a first band, a second band, a third band, a fourth band and a five band, respectively. The frequency ranges of the first band, the second band, the third band, the fourth band and the five band are 700~824 MHz, 824~960 MHz, 1400~1575 MHz, 1710~2170 MHz and 2300~2700 MHz, respectively. It can be seen that the multiband printed antenna 10 of the present invention at least may realize the control of the five bands having different frequency ranges.

Preferably, the positive surface 100*a* and the non-positive surface 100*b* of the substrate 100 of the multiband printed antenna 10 are covered by one layer of black paint, and the black paint covers the conductive layer, so that providing the protection function for the conductive layer.

As described above, the multiband printed antenna 10 of the present invention can separately control multiple radiating portions 120, which have different bands and are together formed on one same substrate 100, to emit the electromagnetic wave signals at one same feeder point 130, thereby realizing the object of the single printed antenna controlling multiple bands and greatly reducing the manufacture cost to satisfy the demand of 4G communication industry.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multiband printed antenna, being adapted to receive and emit multiple electromagnetic wave signals of different bands, wherein the multiband printed antenna comprising: a substrate and a conductive layer formed on a positive surface of the substrate, the conductive layer comprising a grounding portion, a plurality of radiating portions controlling different bands, and a single feeder point used to transmit electromagnetic wave signals; the radiating portions comprising a first radiating portion controlling a first band, a second radiating portion controlling a second band, a fourth radiating portion controlling a fourth band, and a fifth radiating portion controlling a fifth band; the first radiating portion being bent to form an L-shaped gap controlling a third band;

wherein the first radiating portion and the fifth radiating portion are located on the right of the substrate, the first radiating portion being located above the fifth radiating portion and bendingly extending to form the L-shaped gap, the second radiating portion and the fourth radiating portion being located on the left of the substrate, the second radiating portion being bendingly arranged to surround the part of the fourth radiating portion, and the grounding portion being arranged along the lowest of the substrate.

2. The multiband printed antenna as claimed in claim 1, wherein there forms an auxiliary portion, which has a function of parallel capacitor and can provide an auxiliary function for the fifth radiating portion, above the grounding portion.

3. The multiband printed antenna as claimed in claim 1, wherein the frequency range of the first band is 700~824 MHz, the frequency range of the second band is 824~960 MHz, the frequency range of the third band is 1400~1575 MHz, the frequency range of the fourth band is 1710~2170 MHz and the frequency range of the fifth band is 2300~2700 MHz.

4. The multiband printed antenna as claimed in claim 1, wherein all of the radiating portions are a copper-coated layer, and both of the grounding portion and the feeder point are a gold-coated layer.

5. The multiband printed antenna as claimed in claim 1, wherein there forms one layer of black paint on the positive surface and a non-positive surface of the substrate, and the black paint covers the conductive layer.

* * * * *